United States Patent [19]

Ball

[11] 4,323,975

[45] Apr. 6, 1982

[54] ARTICULATED LOADING ARM CONTROL SYSTEM

[75] Inventor: Peter Ball, Sheffield, England

[73] Assignee: FMC Corporation, Chicago, Ill.

[21] Appl. No.: 115,660

[22] Filed: Jan. 28, 1980

[30] Foreign Application Priority Data

Jan. 31, 1979 [GB] United Kingdom ..... 03468/79

[51] Int. Cl.[3] ..... B67D 5/68

[52] U.S. Cl. ..... 364/559; 141/387

[58] Field of Search ..... 364/559, 513, 424; 141/387

[56] References Cited

U.S. PATENT DOCUMENTS

| | | | |
|---|---|---|---|
| 3,636,325 | 1/1972 | Chytil | 364/424 X |
| 3,819,922 | 6/1974 | Horn et al. | 364/559 X |
| 3,934,126 | 1/1976 | Zalesov et al. | 364/424 |
| 3,944,798 | 3/1976 | Eaton | 364/559 |
| 3,986,007 | 10/1976 | Ruoff, Jr. | 364/559 X |
| 4,084,247 | 4/1978 | Ball | 364/559 |
| 4,156,835 | 5/1979 | Whitney et al. | 364/513 X |
| 4,185,280 | 1/1980 | Wilelm | 364/424 X |
| 4,187,454 | 2/1980 | Ito et al. | 364/513 X |
| 4,205,308 | 5/1980 | Haley et al. | 364/559 X |

*Primary Examiner*—Edward J. Wise

*Attorney, Agent, or Firm*—W. W. Ritt, Jr.; L. B. Guernsey; R. B. Megley

[57] ABSTRACT

A system for controlling an articulated loading arm which is mounted on a loading station, and for moving an outer end of the arm into a position above the rail of a tanker moored adjacent the loading station. The system includes a sensor for developing a signal proportional to the height of the tanker rail relative to the loading station, and another sensor for developing a signal proportional to the distance between the tanker and the loading station. The rail height signal and the tanker distance signal are coupled to a computer that develops an output signal which causes the outer end of the loading arm to move into a predetermined position above the tanker rail.

5 Claims, 3 Drawing Figures

ARTICULATED LOADING ARM CONTROL SYSTEM

BACKGROUND OF THE INVENTION

1. Field of the Invention

This invention relates to articulated fluid transferring apparatus, and more particularly to means for controlling the position of marine loading arms and for moving the outer end of such an arm into a predetermined spatial position with respect to a tanker moored adjacent a loading station.

2. Description of the Prior Art

Fluid loading arms constructed of articulated pipe are extensively used in the petroleum industry for transferring oil or other fluids between a jetty, wharf or other loading station and a marine tanker moored alongside. Such an arm generally comprises an inboard boom or limb supported on a vertical riser pipe by pipe swivel joints to facilitate pivotal movement about horizontal and vertical axes, and an outboard boom or limb connected by a pipe swivel joint to the inboard limb so as to be pivotal relative thereto about a horizontal axis. The outer end of the outboard limb is adapted to be connected to a pipe manifold on a tanker located within reach of the arm, such as by a remotely-controllable coupler device.

When it is desired to connect the outer end of the outboard limb to the pipe manifold on the tanker moored alongside the loading station, the movement of a prior art loading arm is controlled by shore-based personnel until the outer end of the arm is located above the tanker's rail. The outer end of the loading arm must be maneuvered over the tanker rail and into position adjacent the tanker manifold without colliding with the tanker rail or any other object which could cause sparks and produce a disastrous explosion. This is difficult to do when the person controlling the movement of the loading arm is on the loading station at a considerable distance from the tanker. When the loading arm is within reach of personnel aboard the tanker, a set of control lines is plugged into a socket mounted on the outer portion of the arm, and personnel aboard the tanker then assume control of the arm to move the outer end of the arm into fluid-tight engagement with a tanker manifold. Fluid can then be transferred between the tanker and the loading station.

When an articulated loading arm installation of this type is being designed, minimum requirements are set for the reach of the arm. These requirements are expressed in terms of the horizontal displacement of the tanker parallel to and away from the jetty relative to a datum position, the maximum displacement away from the jetty due to variations in distance between the tanker manifold and the tanker rail, and the maximum vertical displacement due to variations in the water level and the height of the tanker manifold relative to the water level. These displacements define a three-dimensional space that is rectangular in section when viewed in plan or elevation, either parallel to or perpendicular to the jetty, and the space is known as the arm's "operating envelope". The arm must be able to accommodate all of these displacements so that a safe and secure connection to the tanker's manifold can be established and maintained within the limits of this envelope.

A system for sensing the spatial position of the outer end of an articulated loading arm, and for insuring that the outer end does not move outside the safe operating envelope, is described in the U.S. Pat. No. 4,084,247 issued to Peter Ball and assigned to the assignee of the present invention. However, the apparatus described in that patent does not include either means for determining the location of a tanker manifold relative to the arm limbs, or means for moving the outer end of the arm into position adjacent the tanker manifold.

SUMMARY OF THE INVENTION

The present invention comprises a system for controlling an articulated loading arm which is mounted on a loading station, and for moving the outer end of the arm into a position over the rail of a tanker mounted adjacent the loading station without relying upon human sight and/or judgment. The system includes means for sensing the distance between the tanker and the loading station, and for providing a distance signal proportional to the tanker-to-loading station distance. Another sensing means senses the height of the tanker rail relative to the loading station and provides a height signal proportional to the height of the rail. The loading arm includes means for sensing the position of its outer end relative to the loading station and providing an arm position signal which is coupled to one of the inputs of a computing means. The distance signal and the height signal are also coupled to inputs of the computing means, which computing means develops an output signal that is determined by the values of the signals at the various inputs. The system of this invention also includes a means for using the computer output signal to move the outer end of the loading arm into a predetermined position above the tanker rail. This system thereby provides accurate positioning of the loading arm above the tanker's rail, and thus prevents a collision between the arm and the rail or other structures which could cause sparks and damage to the equipment.

DESCRIPTION OF THE PREFERRED EMBODIMENT

Figure 2:
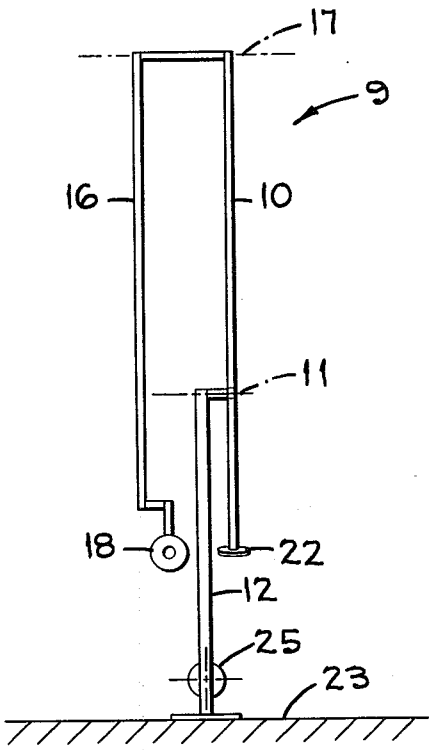
FIG. 2 is a schematic end view of the arm in its stowed position.
Figure 1:
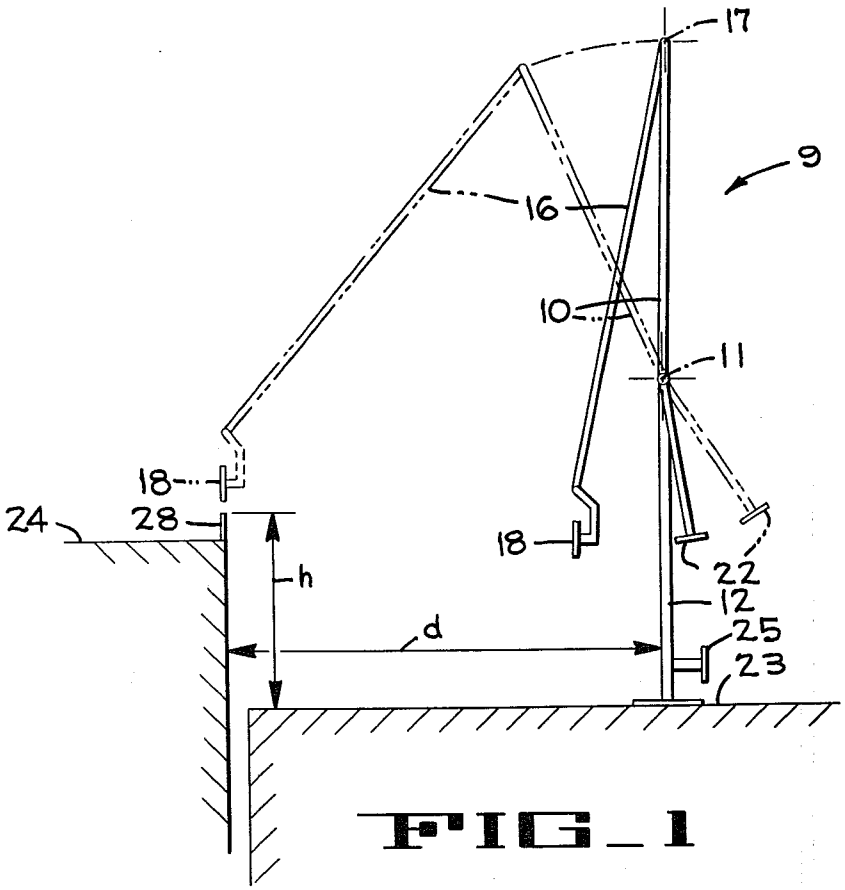
FIG. 1 is a schematic side elevation of an articulated fluid loading arm mounted on a jetty or loading station according to the present invention, illustrating in phantom the arm in an extended position, and showing the arm in its stowed position with full lines.

Referring to FIGS. 1 and 2 of the drawings, an articulated arm 9 according to the present invention is shown comprising an inboard limb 10 pivotally connected about a horizontal axis 11 to a riser or other fixed conduit 12. The articulated arm also comprises an outboard limb 16 pivotally connected about another horizontal axis 17 to the inboard limb, and a connecting device 18, such as a pipe flange or coupler, at the outer end of the limb 16 arranged for connecting the arm to a tanker manifold. The inboard limb 10 and the outboard limb 16 can be pivoted about the horizontal axes 11 and 17 respectively by any of the means (not shown) commonly used for raising and lowering the limbs of an articulated loading arm. A counterweight 22, connected to the inboard limb 10, neutralizes or greatly reduces the tendency of the loading arm to turn about the horizontal axis 11, regardless of the position of the arm. The entire articulated arm assembly is mounted on a jetty or loading station 23 provided with a flexible fender (not shown) to prevent an adjacent marine tanker 24 from causing damage by bumping against the loading station. The riser 12 supports a flange 25 for connection to a fluid pipeline (not shown).

The height h (FIG. 1) of a tanker rail 28 above the loading station 23 can vary over a considerable range due to the type of tanker, the variation in sea level, and the variations in height of a tanker manifold above sea level as the tanker is filled or emptied. The distance d between the tanker 24 and the riser 12 can vary due to the type of tanker and its movement relative to the loading station 23.

Figure 3:
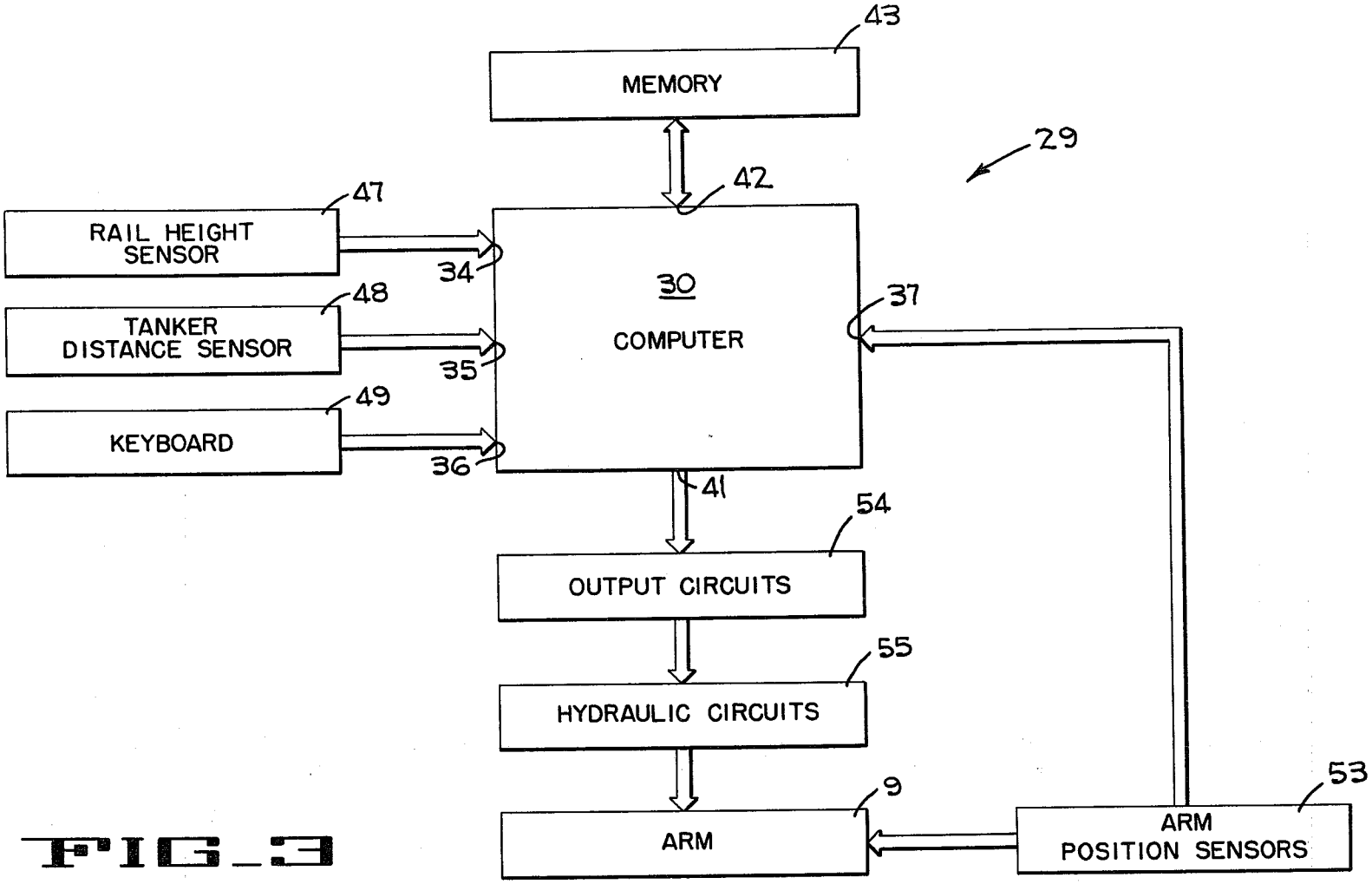
FIG. 3 is a block diagram of a loading arm control system according to the present invention.

A control system 29 for maneuvering the connecting device 18 into a position above the tanker rail 28, as shown by the phantom outline in FIG. 1, is illustrated in FIG. 3. The system 29 includes a computer 30 having a plurality of inputs 34–37, an output 41, and an input-/output 42. An associated memory 43 connected to the input/output 42 of the computer provides storage of data and computer programs for use by the computer 30. A rail height sensor 47 measures the height h (FIG. 1) of the tanker rail 28 above the loading station 23 and provides a signal which is proportional to the value of the height h. The rail height sensor can be a simple theodolite with a potentiometer incorporated therein to provide a height signal voltage proportional to the angle of sighting. The theodolite can be sighted on the tanker rail 28 and the height signal coupled to the computer 30 which uses the signal to calculate the value of h.

A tanker distance sensor 48, which measures the distance d, can be a sonar or laser type distance meter. Such sensors are now in use to measure the distance of a tanker from a jetty and to measure the speed of approach to aid in berthing marine tankers. The sensor 48 provides a distance signal which is proportional to the distance d (FIG. 1) between the tanker 24 and the riser 12.

A plurality of arm position sensors 53 (FIG. 3) are arranged to monitor the angle between the inboard limb 10 (FIG. 1) and a horizontal plane to provide an indication of the orientation of the limb 10 relative to the riser 12, to monitor the angle between the inboard limb 10 and the outboard limb 16, and to monitor the skew angle relative to the loading station 23. The sensors may comprise a variety of transducers (not shown), for example, potentiometers or other known devices to provide analog outputs, or the sensors may comprise a series of limit switches to provide digital outputs. For example, in the case of a potentiometer, the track of the potentiometer can be connected to the limb 10, and the wiper of the potentiometer connected to the limb 16. The signals representative of the various angles of rotation are suitably combined by the computer 30 to provide a composite signal or signals representative of the position of the connecting device 18.

The computer 30 is programmed such that when an instruction is keyed into the computer by way of the keyboard 49, instructing the computer to move the arm to a position above the ship's rail, the inboard limb 10 (FIG. 1) first is inclined backward away from the tanker by a predetermined number of degrees, the outboard limb 16 is raised relative to the limb 10 by another predetermined number of degrees, and the limb 10 is then tipped forward until the connecting device 18 is positioned immediately above the ship's rail 28. The computer provides output signals from the output 41 to a plurality of output circuits 54 which control a plurality of hydraulic circuits 55. The hydraulic circuits 55 provide power to raise and lower the inboard and the outboard limbs 10,16 of the loading arm 9. The angles of the limbs 10,16 are calculated by the computer so that the connecting device 18 assumes a position of, for example, 2 feet above the rail, without moving any closer to the tanker. The computer 30 causes the arm 9 to extend in a plane perpendicular to the edge of the loading station 23. Since the distance d from the tanker 24 to the loading station 23 is known from the sensor 48, and the distance h is known from the height sensor 47, the processing required in the computer 30 is very simple. When the connecting device 18 is above the tanker rail 28, manual control can be assumed by personnel on the tanker 24.

The system of this invention makes it possible to extend a marine arm by simply pushing a button. Of course, a whole series of arms could be controlled sequentially or simultaneously using the same keyboard and computer.

As an addition or alternative to the system of this invention, the computer could be used to automatically retract and/or stow one or more marine arms. In conventional marine arm control systems, an arm can be automatically released from a tanker manifold. An embodiment of the present invention could be provided in which the arm is automatically retracted to a withdrawn position well clear of the tanker. In an emergency, for example, a button could be pressed to disconnect all the arms connected to a tanker, withdraw all the arms, and then actuate hydraulic fenders to push the tanker away from the berth. As an alternative example, in the event of an arm becoming overextended as a result of ship movement, it could be automatically disconnected and withdrawn. Once an arm is withdrawn it could be moved automatically to a stowed position and then latched in place.

Systems are now available for automatically measuring the distance of a tanker from, and speed of approach towards a jetty, and for setting out the information on a large scale display readable from the tanker to assist berthing. Such a system could be integrated with a system according to the present invention.

Although the best mode contemplated for carrying out the present invention has been herein shown and described, it will be apparent that modification and variation may be made without departing from what is regarded to be the subject matter of the invention.

What is claimed is:

1. A system for controlling the position of an articulated loading arm used to load and unload a tanker, said loading arm being mounted on a loading station, said system comprising:

a computer for receiving signals from a plurality of signal sources and for producing control signals to control the movement of said loading arm;

a distance sensor for providing a signal proportional to the distance between a tanker and said loading station;

a rail height sensor for providing a signal proportional to the height of a tanker rail relative to said loading station;

a plurality of arm position sensors for providing signals determined by the spatial position of an outer end of said loading arm relative to said loading station;

a computer memory connected to said computer and to said sensors for storing said arm position signals, said distance signals and said rail height signals; and a keyboard connected to said computer for providing signals to said computer to cause said computer to compare the spatial position of said outer end of said loading arm with the position of said tanker and cause said computer to develop said control signals to move said loading arm into position for connecting said loading arm to said tanker.

2. A system for controlling the position of a loading arm as defined in claim 1 including means for moving said loading arm in response to said control signals.

3. A system for controlling a loading arm as defined in claim 2 wherein said means for moving said loading arm includes a plurality of hydraulic circuits connected between said loading arm and said computing means.

4. A system for controlling a loading arm as defined in claim 3 wherein said means for moving said loading arm further includes a plurality of output circuits connected between said hydraulic circuits and said computing means.

5. A system for controlling a loading arm as defined in claim 1 wherein said rail height sensor is a theodolite.

* * * * *